US010217410B2

(12) United States Patent
Moon

(10) Patent No.: US 10,217,410 B2
(45) Date of Patent: Feb. 26, 2019

(54) LIGHT EMISSION CONTROLLER FOR DISPLAY DEVICE, METHOD OF DRIVING THE SAME, AND ORGANIC LIGHT-EMITTING DISPLAY DEVICE INCLUDING THE SAME

(71) Applicant: LG Display Co., Ltd., Seoul (KR)

(72) Inventor: Su-Hwan Moon, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/827,182

(22) Filed: Nov. 30, 2017

(65) Prior Publication Data

US 2018/0151113 A1 May 31, 2018

(30) Foreign Application Priority Data

Nov. 30, 2016 (KR) ..... 10-2016-0162359

(51) Int. Cl.

| | |
|---|---|
| ***G09G 3/325*** | (2016.01) |
| ***G09G 3/3258*** | (2016.01) |
| ***G09G 3/3233*** | (2016.01) |
| *G09G 3/3291* | (2016.01) |

(52) U.S. Cl.

CPC ..... *G09G 3/325* (2013.01); *G09G 3/3233* (2013.01); *G09G 3/3258* (2013.01); *G09G 3/3291* (2013.01); *G09G 2300/0814* (2013.01); *G09G 2310/0297* (2013.01)

(58) Field of Classification Search

CPC .... G09G 3/325; G09G 3/3291; G09G 3/3258; G09G 2310/0297; G09G 2300/0814

USPC ..... 345/76

See application file for complete search history.

(56) References Cited

U.S. PATENT DOCUMENTS

| | | | | |
|---|---|---|---|---|
| 7,215,087 | B2 * | 5/2007 | Matsushima | H05B 41/2827 315/274 |
| 9,379,171 | B2 * | 6/2016 | Minami | G09G 3/3233 |
| 2008/0062071 | A1 * | 3/2008 | Jeong | G11C 19/184 345/46 |
| 2010/0182226 | A1 * | 7/2010 | Umezaki | G02F 1/13454 345/98 |
| 2014/0055444 | A1 * | 2/2014 | Jang | G09G 3/3291 345/213 |
| 2014/0152629 | A1 * | 6/2014 | So | G11C 19/28 345/205 |
| 2015/0054571 | A1 * | 2/2015 | Watanabe | H02M 3/073 327/536 |

(Continued)

*Primary Examiner* — Fred Tzeng

(74) *Attorney, Agent, or Firm* — Morgan, Lewis & Bockius LLP

(57) ABSTRACT

A light emission controller includes: a plurality of stages, including: a first node (n1) controller charging a driving pulse of a gate-on voltage level to a set node (Q) by a reference clock pulse during an active period, a second node controller charging a pull-down voltage having the gate-on voltage level to a reset node during an inactive period, and an output unit controlled by voltage states of the Q and the reset node and outputting an active or inactive state output pulse, the n1 controller including: a first switching transistor supplying the driving pulse of the gate-on voltage level to n1 by the reference clock pulse during the active period, a second switching transistor supplying the driving pulse from n1 to the Q by a turn-on voltage, a first capacitor between the output unit and Q, and a second capacitor between the output unit and n1.

19 Claims, 15 Drawing Sheets

(56) References Cited

U.S. PATENT DOCUMENTS

| | | | | |
|---|---|---|---|---|
| 2016/0005346 | A1* | 1/2016 | Kim | G09G 3/3266 345/690 |
| 2016/0155409 | A1* | 6/2016 | Jeoung | G09G 5/003 345/214 |
| 2016/0210892 | A1* | 7/2016 | Ohara | G09G 3/3258 |
| 2016/0225829 | A1* | 8/2016 | Wu | G06F 3/042 |
| 2016/0240146 | A1* | 8/2016 | Lee | G09G 3/3291 |
| 2016/0365035 | A1* | 12/2016 | Park | G09G 3/3266 |
| 2017/0069265 | A1* | 3/2017 | Zhou | G09G 3/3233 |
| 2017/0092199 | A1* | 3/2017 | Park | G09G 3/3258 |
| 2017/0200418 | A1* | 7/2017 | Zhang | G11C 19/28 |

* cited by examiner

LIGHT EMISSION CONTROLLER FOR DISPLAY DEVICE, METHOD OF DRIVING THE SAME, AND ORGANIC LIGHT-EMITTING DISPLAY DEVICE INCLUDING THE SAME

CROSS-REFERENCE TO RELATED APPLICATIONS

This application claims the priority of Korean Application No. 10-2016-0162359, filed on Nov. 30, 2016, the entirety of which is hereby incorporated by reference.

BACKGROUND

1. Technical Field

The present disclosure relates to a light emission controller for a display device, a method of driving the same, and an organic light-emitting display device including the same.

2. Discussion of the Related Art

A recently-emerging flat panel display includes a liquid crystal display, a field emission display, a plasma display panel, an organic light-emitting display, etc. Thereamong, the organic light-emitting display is a self-luminescent device that causes an organic light-emitting layer to emit light through recombination of electrons and holes, and is expected as a next-generation display device due to high luminance, low driving voltage, and ultra-thin-film thickness.

Each of a plurality of unit pixels constituting the organic light-emitting display includes an organic light-emitting diode, including an organic light-emitting layer between an anode and a cathode, and a pixel circuit for independently driving the organic light-emitting diode. To drive the pixel circuit, the light-emitting display may further include a gate driver for supplying scan signals to the pixels through gate lines, a data driver for supplying data signals to the pixels through data lines, and a light emission controller for supplying light emission control signals to the pixels through light emission control lines.

In this case, the light emission controller continues to supply an active signal to the pixels during a time period, except for a time period for charging a data signal in the pixels. In this case, upon supplying the active signal, if a voltage charged in a charging node for controlling output of the light emission controller does not maintain a constant level due to parasitic capacitance, and is raised or lowered, a switching transistor for controlling the charging node is undesirably turned on. Thus, the voltage charged in the charging node may leak. As such, a voltage output through the light emission controller becomes unstable and display picture quality of images is deteriorated.

SUMMARY

Accordingly, the present disclosure is directed to a light emission controller for a display device, a method of driving the same, and an organic light-emitting display device including the same that substantially obviate one or more of the issues due to limitations and disadvantages of the related art.

In one aspect, embodiments of the present disclosure may provide a light emission control signal driver for stably maintaining output of the light emission controller, a method of driving the same, and a display device including the same.

In another aspect, embodiments of the present disclosure may provide a light emission controller capable of stabilizing a light emission control signal by reducing or preventing a voltage charged in a charging node from leaking upon outputting the light emission control signal of a light emission controller, and maintaining a voltage level charged in the charging node at a predetermined value, a method of driving the same, and an organic light-emitting display device using the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a light emission controller for a display device, including: a plurality of stages cascade-connected to each other, each of the stages including: a first node controller configured to, during an active period, charge a driving pulse of a gate-on voltage level to a set node in response to a reference clock pulse that is any one of a plurality of externally input clock pulses, a second node controller configured to, during an inactive period, charge a pull-down voltage having the gate-on voltage level to a reset node, and an output unit controlled according to voltage states of the set node and the reset node and configured to output an output pulse of an active state or an inactive state, wherein the first node controller includes: a first switching transistor configured to, during the active period, supply the driving pulse of the gate-on voltage level to a first node in response to the reference clock pulse, a second switching transistor configured to supply the driving pulse from the first node to the set node in response to a turn-on voltage, a first capacitor connected between the output unit and the set node, and a second capacitor connected between the output unit and the first node.

In another aspect, there is provided an organic light-emitting display device, including: a display panel including: a light-emitting element, a pixel driver configured to drive the light-emitting element, and a plurality of pixels in a matrix, a gate driver configured to supply a scan signal to each of the pixels, a data driver configured to supply a data signal to each of the pixels, a light emission controller configured to supply a light emission control signal for controlling light emission of the light-emitting element to each of the pixels, and a timing controller configured to control the gate driver, the data driver, and the light emission controller to control a display timing of each of the pixels.

In another aspect, there is provided a method of driving a light emission controller for a display device, the light emission controller including a plurality of stages cascade-connected to each other, each of the stages including a first node controller, a second node controller, and an output unit, the first node controller including a first switching transistor, a second, a first capacitor connected between the output unit and the set node, and a second capacitor connected between the output unit and the first node, the method including: during an active period: by the first node controller, charging a driving pulse of a gate-on voltage level to a set node in response to a reference clock pulse that is any one of a plurality of externally input clock pulses, and by the first switching transistor, supplying the driving pulse of the gate-on voltage level to a first node in response to the reference clock pulse, during an inactive period, by the second node controller, charging a pull-down voltage having the gate-on voltage level to a reset node, controlling the output unit according to voltage states of the set node and the reset node to output an output pulse of an active state or an inactive state, and by the second switching transistor, supplying the driving pulse from the first node to the set node in response to a turn-on voltage.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

Figure 1:
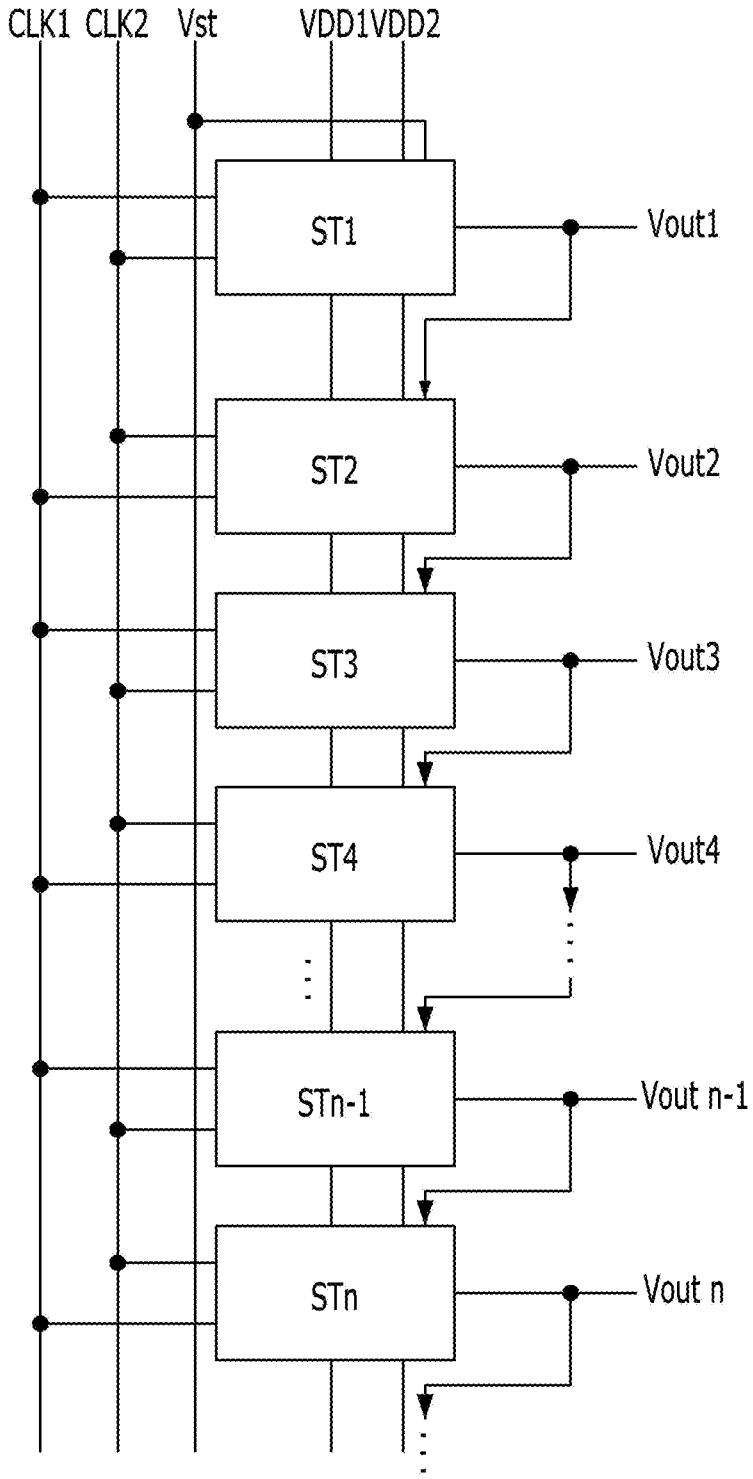
FIG. 1 is a diagram illustrating a configuration of a light emission controller according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

A light emission controller according to an embodiment of the present disclosure will be described in more detail with reference to the attached drawings.

FIG. 1 is a diagram illustrating a configuration of a light emission controller according to an embodiment of the present disclosure.

The light emission controller illustrated in FIG. 1 may include a plurality of stages ST1 to STn cascade-connected to each other. The light emission controller may supply, to a plurality of light emission control lines, a light emission control signal having the form of output pulses Vout1 to Voutn for controlling light emission of a light-emitting element provided in a display panel. The light emission control signal may be divided into an active signal and an inactive signal. The active signal may refer to a control signal for causing the light-emitting element to emit light by turning on a switching element for controlling light emission of the light-emitting element. The inactive signal may refer to a control signal for causing the light-emitting element to not emit light by turning off the switching element for controlling light emission of the light-emitting element. However, the active and inactive signals are not limited to the above-described meaning.

Each of the stages ST1 to STn may include an inactive period in which the inactive signal may be output once during one frame period, and an active period in which the active signal may be continuously output. Although the inactive signal may be sequentially output by stages from the first stage ST1 to the last stage STn, embodiments of the present disclosure are not limited thereto.

The active signal may be a signal having a gate-on voltage level. If thin-film transistors constituting each pixel driving circuit are p-type transistors, the active signal may be a gate low voltage. If the thin-film transistors are n-type transistors, the active signal may be a gate high voltage.

On the contrary, the inactive signal may be a signal having a gate-off voltage level. If the thin-film transistors are p-type transistors, the inactive signal may be a gate high voltage. If the thin-film transistors are n-type transistors, the inactive signal may be a gate low voltage.

As described above, the plurality of stages ST1 to STn may drive the light emission control lines connected thereto using the output pulses Vout1 to Voutn, and may simultaneously control an operation of stages located thereafter. For example, a $k^{th}$ (where k may be a natural number) output pulse output from a $k^{th}$ stage may be supplied to a $k^{th}$ light emission control line and simultaneously supplied to a $(k+1)^{th}$ stage.

With reference to FIG. 1, each of the stages ST1 to STn of the light emission controller may receive a first voltage VDD1 having a gate-on voltage level, a second voltage VDD2 having a gate-off voltage level, a first clock pulse CLK1 swinging between the gate-on voltage level and the gate-off voltage level, and a second clock pulse CLK2 having a phase opposite to the first clock pulse CLK1. A start pulse Vst may be supplied to the first stage ST1 among the stages ST1 to STn. The number of clock pulses may vary according to a circuit configuration of each stage.

The gate-on voltage level may be configured to turn on switching transistors included in the stages ST1 to STn, and the gate-off voltage level may be configured to turn off the switching transistors. In one example, the gate-off voltage level may differ depending on types of switching transistors included in the stages ST1 to STn. For example, if the switching transistors included in the stages ST1 to STn are p-type transistors, the gate-on voltage level may be a gate low voltage level VGL, and the gate-off voltage level may be a gate high voltage level VGH. On the other hand, if the switching transistors included in the stages ST1 to STn are n-type transistors, the gate-on voltage level may be the gate high voltage level VGH, and the gate-off voltage level may be the gate low voltage level VGL. The gate low voltage level may be set to a voltage level of a negative polarity, and the gate high voltage level may be set to a voltage level of a positive polarity.

As described previously, because the first clock pulse CLK1 may swing between the gate-on voltage level and the gate-off voltage level, the first clock pulse CLK1 may be periodically generated to have amplitudes of the gate high voltage level VGH and the gate low voltage level VGL. The second clock pulse CLK2 may be configured to have an inverted phase with respect to the first clock pulse CLK1.

Figure 2:
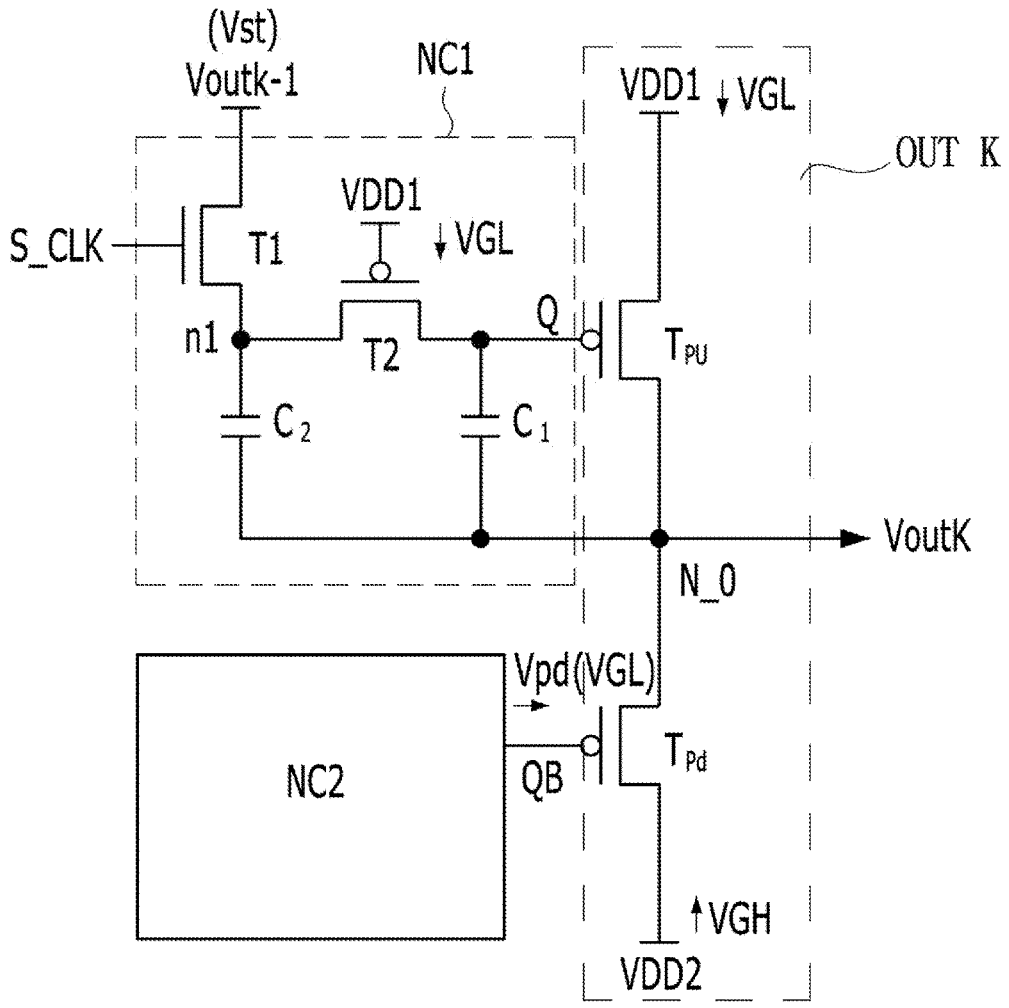
FIG. 2 is a diagram illustrating a circuit configuration of a $k^{th}$ stage STk among stages shown in FIG. 1.

FIG. 2 is a diagram illustrating a circuit configuration of a $k^{th}$ stage STk among the stages shown in FIG. 1.

Each of the stages ST1 to STn may include a first node controller NC1 for charging a output pulse VoutK−1 from the previous $(k-1)^{th}$ stage to a set node Q, in response to either the first clock pulse CLK1 or the second clock pulse CLK2, during an active period in which an active signal may be output. Each of the stages ST1 to STn may further include a second node controller NC2 for supplying a pull-down voltage having a gate-on voltage level to a reset node QB during an inactive period in which an inactive signal may be output. Each of the stages ST1 to STn may also include an output unit outK for outputting an output pulse of an active or inactive state according to logic states of the set node Q and the reset node QB. A clock pulse for controlling the set node Q of the first node controller NC1, out of the first clock pulse CLK1, and the second clock pulse CLK2, may be referred to as a "reference clock pulse S_CLK" and the other clock pulse may be referred to as an "inverted clock pulse R_CLK." In some of the stages, the first clock pulse CLK1 may become the reference clock pulse, and in the other stages, the second clock pulse CLK2 may become the reference clock pulse. For example, in odd stages, the first clock pulse CLK1 may be the reference clock pulse, and in even stages, the second clock pulse CLK2 may be the reference clock pulse, or vice versa.

In addition, all switching transistors included in the first node controller NC1, the second node controller NC2, and the output unit outK may be p-type transistors or n-type transistors. The p-type transistors are described herein as an example of the switching transistors, but embodiments are not limited thereto. When all of the switching transistors are n-type transistors, the first clock pulse CLK, the second clock pulse CLK2, and the start pulse Vst may be input and output with inverted waveforms. In that case, driving of the switching transistors may be the same as an example in which all of the switching transistors are p-type transistors, except that the gate-on voltage may be the gate high voltage level VGH and the gate-off voltage may be the gate low voltage level VGL. Therefore, examples in which the switching transistors are p-type transistors is described for convenience.

The first stage ST1 among the stages ST1 to STn may not include a previous stage. Therefore, the first stage ST1 may charge the start pulse Vst to the set node Q, in response to the first clock pulse CLK1. However, the first stage ST1 is not limited to such a configuration.

The first node controller NC1 may include a first switching transistor $T_1$, a second switching transistor $T_2$, a first capacitor $C_1$, and a second capacitor $C_2$. The first switching transistor $T_1$ may include a gate electrode connected to a reference clock transmission line for supplying the reference clock pulse S_CLK, a source electrode connected to an output terminal of a previous stage STk−1, and a drain electrode connected to a first node n1. The second switching transistor $T_2$ may include a gate electrode connected to a gate-on voltage source, e.g., a first voltage source VDD1 for supplying a gate low voltage level VGL, a source electrode connected to the first node n1, and a drain electrode connected to the set node Q.

The first capacitor $C_1$ may be connected between an output terminal N-O of an output unit outK and the set node Q. The second capacitor $C_2$ may have one end commonly connected to the output terminal N-O with the first capacitor $C_1$ and the other end connected to the first node n1. That is, the second capacitor $C_2$ may be connected between the output terminal N-O of the output unit outK and the first node n1.

The reference clock pulse S_CLK may continue to swing between the gate-on voltage and the gate-off voltage, regardless of an active period and an inactive period. Because the inverted clock pulse R_CLK may have a waveform of an inverted phase with respect to the reference clock pulse S_CLK, the inverted clock pulse R_CLK may also continue to swing between the gate-on voltage and the gate-off voltage. For convenience, in the active period, a period in which the reference clock pulse S_CLK has a gate-on voltage level may be referred to as a "charging period," and a period in which the reference clock pulse S_CLK has a gate-off voltage level may be referred to as a "maintenance period."

During the charging period in which the reference clock pulse S_CLK has the gate-on voltage level in the active period, the first switching transistor $T_1$ may supply a driving pulse to the first node n1 in response to the reference clock pulse S_CLK. The driving pulse may be a previous output pulse VoutK−1, which may be output from the output terminal N-O of a previous stage STk−1. In the case of the first stage ST1, the driving pulse may be a start pulse Vst. For example, the driving pulse may be either the start pulse or the previous output pulse VoutK−1. Because the FIG. 2 example shows the $k^{th}$ stage STk, the driving pulse may correspond to the previous output pulse VoutK−1. The driving pulse may be changed to be the gate-on voltage level or gate-off voltage level.

The second switching transistor $T_2$ may be turned on because the gate electrode thereof may be connected to the first voltage source VDD1. Then, the driving pulse may be supplied to the set node Q via the first node n1 and the second switching transistor $T_2$, thereby turning on a pull-up transistor $T_{pu}$. Then, an output pulse VoutK having the gate low level, e.g., the gate-on voltage level, may be output through the output terminal N-O via the turned-on pull-up transistor $T_{pu}$. In addition, the gate-on voltage may be charged in first and second capacitors $C_1$ and $C_2$ by the driving pulse.

During the maintenance period in which the reference clock pulse S_CLK has the gate-off voltage level, the first transistor $T_1$ may be turned off. In this case, the first node n1 and the set node Q may maintain the gate-on voltage level by the voltage charged in the first and second capacitors $C_1$ and $C_2$. Thus, the pull-up transistor $T_{pu}$ may maintain the turned-on state. Therefore, even during the maintenance period, the output voltage VoutK having the gate-on voltage level may be output through the output terminal N-O through the turned-on pull-up transistor $T_{pu}$ as the active signal.

During at least a part of the inactive period, for example, during a period in which the clock pulse S_CLK has the gate-on voltage level, the driving pulse VoutK−1 may be output to have the gate-off voltage level. Then, the driving pulse of the gate-off voltage may be supplied to the first node n1 through the turned-on first switching transistor $T_1$ and the driving pulse of the gate-off voltage may be supplied to the set node Q through the second switching transistor $T_2$. In addition, because the gate-off voltage may be charged in the first and second capacitors $C_1$ and $C_2$ by the driving pulse, the gate-on voltage may be discharged.

Then, a voltage having the gate-off voltage level may be supplied to the pull-up transistor $T_{pu}$ by the set node Q, the pull-up transistor $T_{pu}$ may be turned off. Next, even during a period in which the clock pulse S_CLK has the gate-off voltage level, because the first node n1 and the set node Q may maintain the gate-off voltage level by the voltage charged in the first and second capacitors $C_1$ and $C_2$, the pull-up transistor $T_{pu}$ may maintain the turned-off state.

The second node controller NC2 may supply, during the active period, the gate-off voltage, e.g., a voltage of the gate high voltage level VGH in the example of FIG. 2, to the reset node QB. Therefore, the reset node QB may have the voltage of the gate high voltage level VGH, and the voltage of the gate high voltage level VGH may be supplied to the gate electrode of a pull-down transistor $T_{pd}$, thereby turning off the pull-down transistor $T_{pd}$.

During the inactive period, the second node controller NC2 may supply a pull-down voltage Vpd of the gate-on voltage level, e.g., the gate low voltage level VGL in the example of FIG. 2, to the reset node QB. Therefore, the reset node QB may have the same voltage level as the pull-down voltage, and the pull-down voltage having the gate low voltage level VGL may be supplied to the gate electrode of the pull-down transistor $T_{pd}$, thereby turning on the pull-down transistor $T_{pd}$. Then, as described above, during the inactive duration, because the pull-up transistor $T_{pu}$ has been turned off, the second voltage VDD2 supplied from a second voltage source having the gate-off voltage level, e.g., the gate high voltage level VGH, may be output to the output pulse VoutK through the output terminal N-O as an inactive signal.

The first node controller NC1 of the light emission controller according to an embodiment of the present disclosure may further include the second capacitor $C_2$ between the output terminal N-O and the first node n1, in addition to the first capacitor $C_1$ between the set node Q and the output terminal N-O. Meanwhile, a conventional first node controller NC1 includes only a single (first) capacitor, and does not include a second capacitor.

Figure 3A:
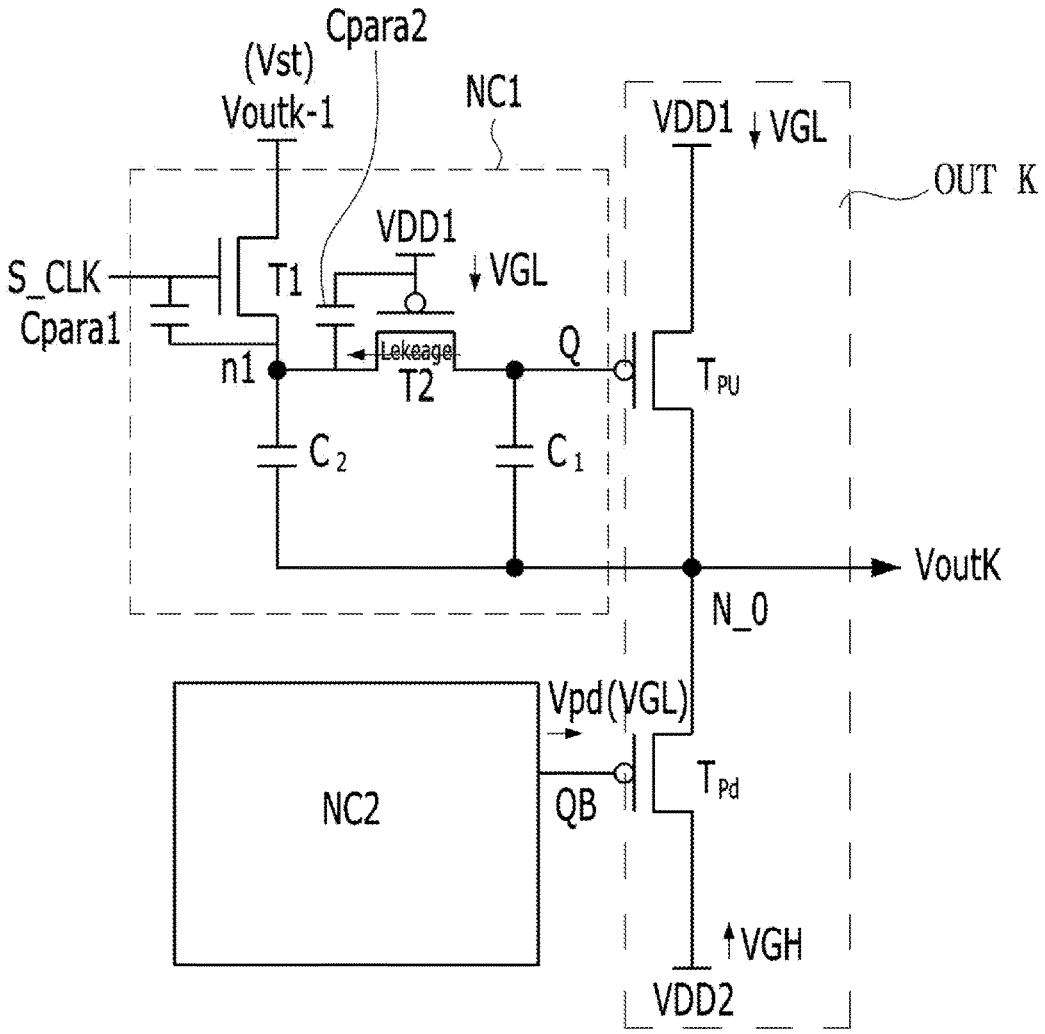
FIGS. 3A and 3B are diagrams illustrating voltage maintenance effects in the light emission controller according to an embodiment of the present disclosure as compared with the prior art.
Figure 3B:
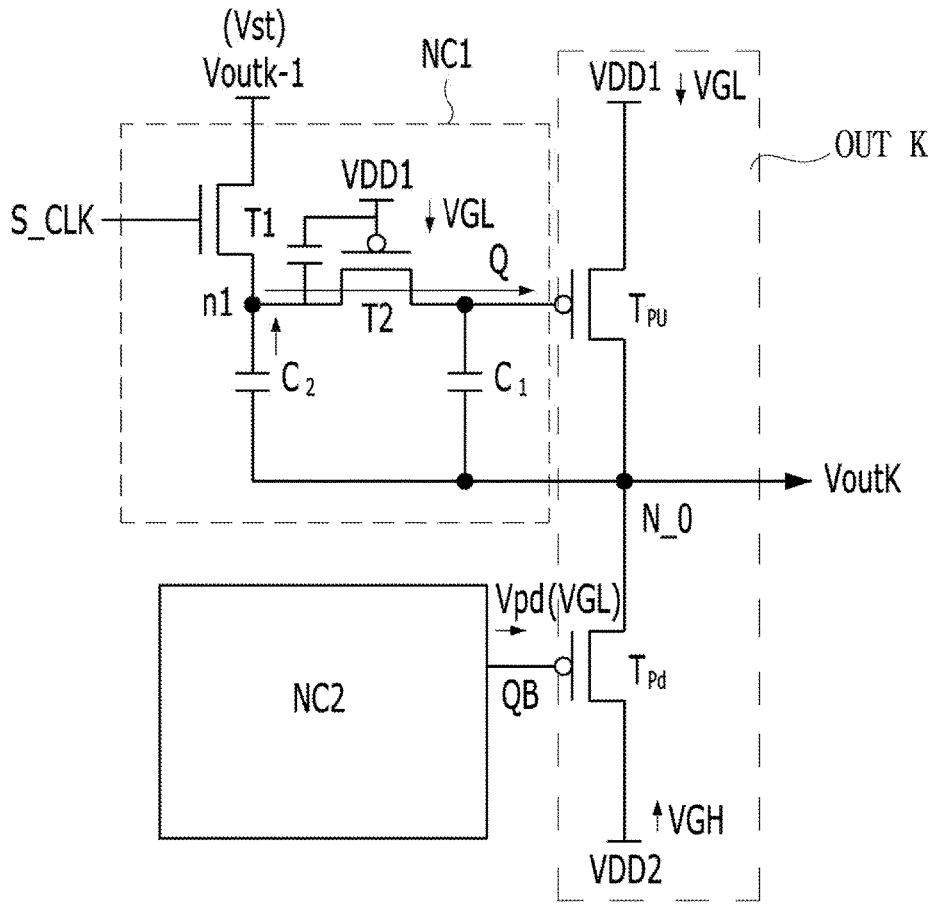

FIGS. 3A and 3B are diagrams illustrating voltage maintenance effects in the light emission controller according to an embodiment of the present disclosure as compared with the prior art.

If the reference clock pulse is supplied as the gate-off voltage level, and if the voltage of the set node Q is maintained using the voltage charged in the first capacitor $C_1$, the first node n1 may maintain the gate-off voltage. Then, a gate-to-source voltage (Vgs) of the second transistor $T_2$ may become 0, thereby turning off the second transistor $T_2$. However, a conventional first node controller NC1 may generate parasitic capacitances Cpara1 and Cpara2 between a supply line of the reference clock pulse S_CLK and the source electrode of the second transistor $T_2$, and between the gate electrode and source electrode of the second transistor $T_2$. Due to this phenomenon, the voltage of the first node n1 may vary and the second transistor $T_2$ may be turned on a small amount.

For example, as illustrated in FIG. 3A, if switching transistors $T_1$, $T_2$, and $T_{pu}$ are, for example, p-type transistors, the voltage of the first node n1 may be raised by a parasitic capacitance, and the gate-to-source voltage Vgs of the second transistor $T_2$ may be 0 or less. Then, the second transistor $T_2$ may be turned on. In this case, a voltage charged in the set node Q may leak in a first node direction, and the voltage charged in the set node Q may not maintain the gate-on voltage level. As a result, the output pulse output to the output terminal N-O may not reach a target voltage level. Thus, a signal transmitted to a display device may be distorted.

On the other hand, as illustrated in FIG. 3B, the first node controller NC1 according to an embodiment of the present disclosure may further include the second capacitor $C_2$ between the first node n1 and the output terminal N-O. The light emission controller, including the first node controller NC1 according to an embodiment of the present disclosure, may further include the second capacitor $C_2$ between the first node and the output terminal. Then, the first node controller NC1 may control the voltage level of the first node n1, such that the second switching transistor $T_2$ may be sufficiently turned off by the voltage level of the first node n1, using the voltage stored in the second capacitor $C_2$.

For example, when the second switching transistor $T_2$ is a p-type transistor, the first node controller NC1 may maintain a Vgs of the second switching transistor $T_2$ at 0 or more by maintaining the voltage level of the first node n1 at a sufficiently low level. Thus, the second switching transistor $T_2$ may be stably turned off.

In addition, in the light emission controller according to an embodiment of the present disclosure, even when the second transistor $T_2$ is floated or is unstably turned on, because the first node n1 may form the same potential as the set node Q, the voltage charged in the set node Q may not leak through the second transistor $T_2$.

The second node controller NC2 may be configured in various ways according to an embodiment. Hereinafter, the light emission controller including the second node controller NC2 according to an embodiment of the present disclosure will be described. It should be noted that the second node controller NC2 is not limited to description herein, and may be variously formed. It should be further noted that, while a structure according to an embodiment is illustrated in the FIG. 3A example, it is being used only as a backdrop to show the leakage and parasitic capacitances that would occur in the prior art, and the leakage and parasitic capacitances are reduced or prevented by the embodiments.

Figure 4:
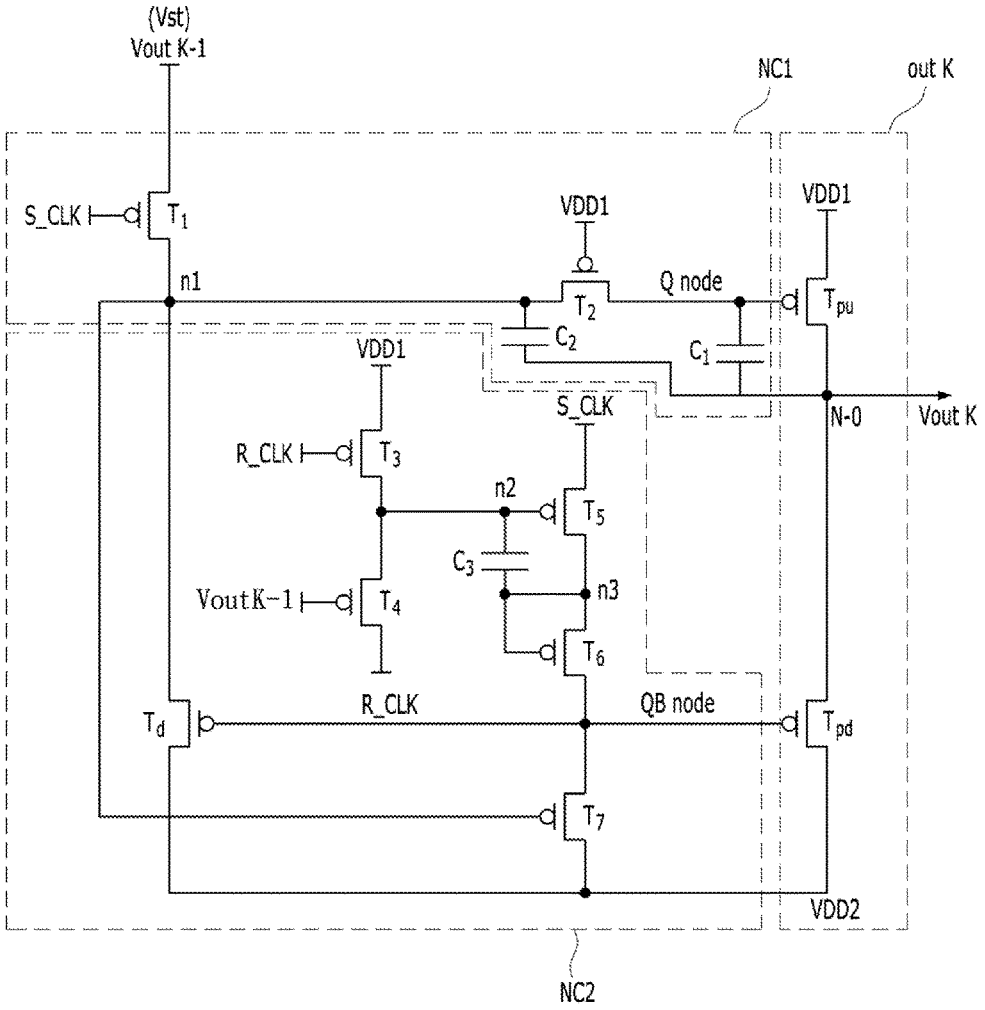
FIG. 4 is a diagram illustrating a light emission controller including a second node controller according to a first embodiment of the present disclosure.

FIG. 4 is a diagram illustrating a light emission controller including a second node controller NC2 according to a first embodiment of the present disclosure.

The first node controller NC1 and the output unit outK may be the same as those illustrated in the FIG. 2 example. Therefore, a detailed description thereof is omitted. The second node controller NC2 may include a third switching transistor $T_3$, a fourth switching transistor $T_4$, a fifth switching transistor $T_5$, a sixth transistor $T_6$, a seventh switching transistor $T_7$, a discharge transistor $T_d$, and a third capacitor $C_3$.

The third switching transistor $T_3$ may have a gate electrode connected to an inverted clock transmission line for supplying the inverted clock pulse R_CLK, a source electrode connected to a first voltage source to receive the first voltage VDD1 having the gate turn-on voltage level, e.g., a gate low voltage level VGL of the FIG. 2 example, and a drain electrode connected to a second node n2. The fourth switching transistor $T_4$ may have a gate electrode connected to a driving pulse transmission line for supplying a driving pulse VoutK−1, a source electrode connected to an inverted clock transmission line for supplying the inverted clock pulse R_CLK, and a drain electrode connected to the second node n2.

The fifth switching transistor $T_5$ may have a gate electrode connected to the second node n2, a source electrode connected to a reference clock transmission line for transmitting the reference clock pulse S_CLK, and a drain electrode connected to a third node n3. The sixth transistor $T_6$ may have source and gate electrodes connected, e.g., in a diode form, to the third node n3 and a drain electrode connected to a reset node QB. The seventh switching transistor $T_7$ may have a source electrode connected to a second voltage source to receive the second voltage VDD2 having a gate turn-off voltage level, e.g., a gate high voltage level VGH, a drain electrode connected to the reset node QB, and a gate electrode connected to a first node n1.

The discharge transistor $T_3$ may have a gate electrode connected to the reset node QB, a source electrode connected to the first node n1, and a drain electrode connected to the second voltage source to receive the second voltage VDD2. The third capacitor $C_3$ may be connected between the gate electrode of the fifth switching transistor $T_5$ and the gate electrode of the sixth switching transistor $T_6$.

The third switching transistor $T_3$ may supply a first voltage VDD1 from the first voltage source having the gate-on voltage level, e.g., the gate low level voltage level VGL, to the second node n2, in response to the inverted clock pulse R_CLK. The fifth switching transistor $T_5$ may supply the reference clock pulse S_CLK to the reset node QB through the sixth switching transistor $T_6$ as a pull-down voltage, according to a logic state of the second node n2. The sixth switching transistor $T_6$ may be connected, e.g., in a diode form, to the fifth switching element $T_5$.

The seventh switching transistor $T_7$ may change a voltage charged in the reset node QB to the gate turn-on voltage level, e.g., the gate high voltage level VGH, as the second voltage VDD2 supplied from the second voltage source, in response to a driving pulse having the gate-on voltage level supplied from the first node n1. That is, the seventh switching transistor $T_7$ may supply a second voltage of the gate-off voltage level to the reset node QB in response to the driving pulse supplied from the first node n1, thereby discharging the reset node QB.

The discharge transistor $T_d$ may be turned on when the reset node QB has the gate turned-on voltage level, e.g., the gate low voltage level. Thus, the discharge transistor $T_d$ may supply the second voltage VDD2 from the second voltage source to the first node n1, thereby discharging the first node n1 and the set node QB.

The first voltage input through the third switching transistor $T_3$ may be charged in the third capacitor $C_3$. The fourth switching transistor $T_4$ may supply the inverted clock pulse R_CLK to the second node n2 in response to a driving pulse VoutK−1 of the gate turn-on voltage level. For example, the fourth switching transistor $T_4$ may discharge the first voltage charged in the third capacitor $C_3$ by outputting the inverted clock pulse R_CLK of the gate high voltage level VGH, e.g., the gate-off voltage level.

Figure 5:
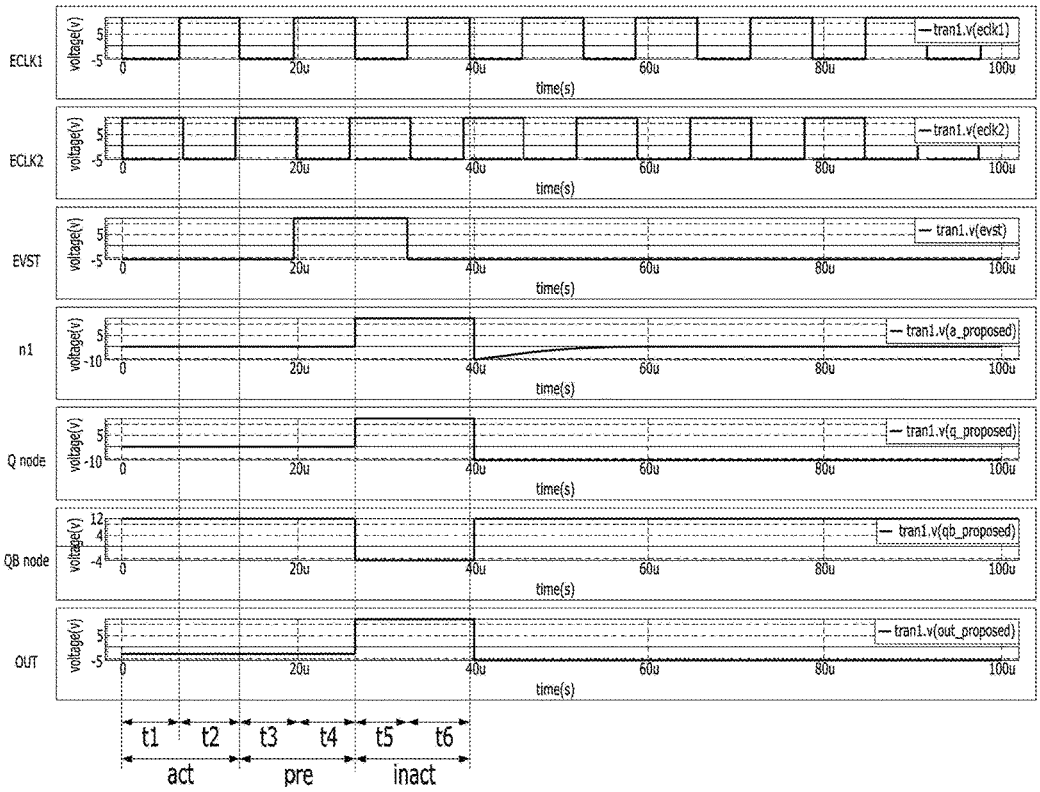
FIG. 5 is a waveform chart illustrating driving of each stage of the light emission controller shown in FIG. 4.

FIG. 5 is a waveform chart illustrating driving of each stage of the light emission controller shown in FIG. 4. FIGS. 6A to 6F are circuit diagrams illustrating a driving method of the light emission controller shown in FIG. 4.

In FIG. 5, a driving pulse corresponds to a previous output pulse Voutn−1 (see FIG. 1) as an example. Alternatively, the driving pulse in the first stage may be the start pulse Vst.

With reference to FIG. 5, stages ST1 to STn (see FIG. 1) of the light emission controller may be dividedly driven during an active period "act," a preparation period "pre," and an inactive period "inact." During the active period act, the reference clock pulse S_CLK and the inverted clock pulse R_CLK may swing such that waveforms thereof may be inverted, and a driving pulse may maintain the gate-on voltage level. Accordingly, the active period act may be divided into a charging period t1, during which the reference clock pulse S_CLK has the gate-on voltage level and the inverted clock pulse R_CLK has the gate-off voltage level, and a maintenance period t2, during which the reference clock pulse S_CLK has the gate-off voltage level and the inverted clock pulse R_CLK has the gate-on voltage level.

During the charging period t1, the reference clock pulse S_CLK may be input as the gate-on voltage level, and the inverted clock pulse R_CLK may be input as the gate-off voltage level. In addition, the driving pulse may be input as the gate-on voltage level.

Figure 6A:
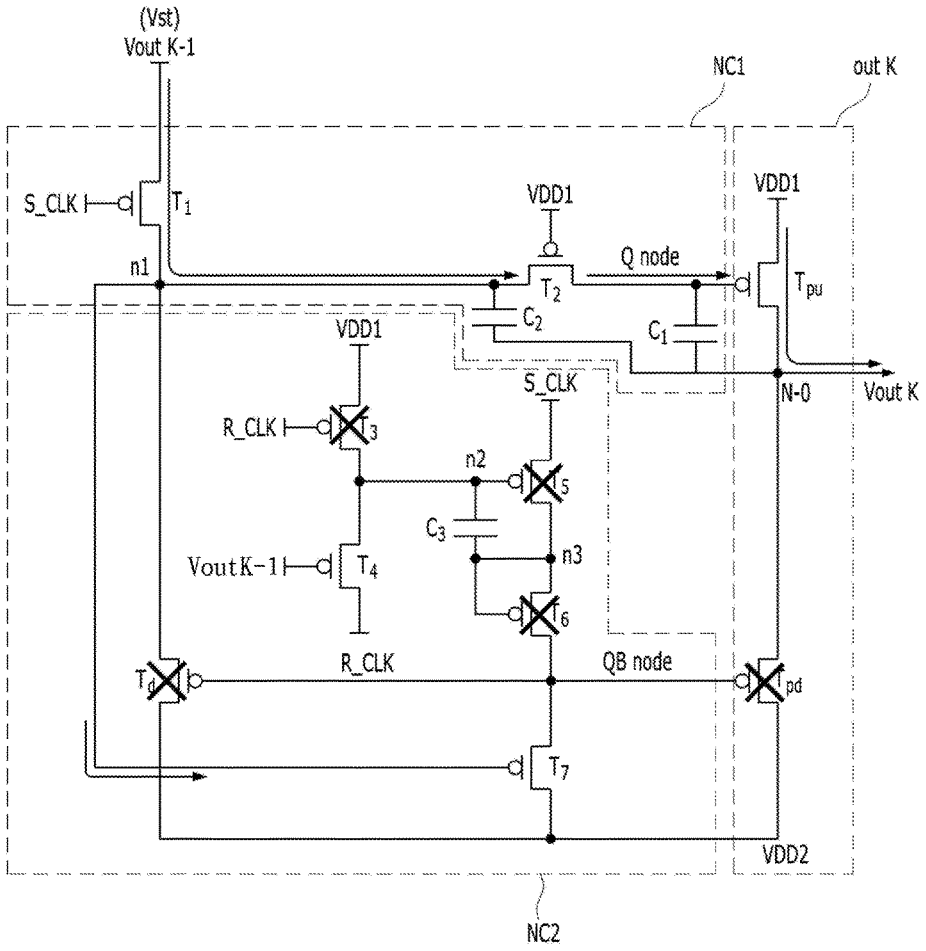
FIGS. 6A to 6F are circuit diagrams illustrating a driving method of the light emission controller shown in FIG. 4.

Then, as illustrated in the FIG. 6A example, the first switching transistor $T_1$ may be turned on by the reference clock pulse S_CLK of the gate-on voltage level. Then, a driving pulse Voutn−1 of the gate-on voltage level may be supplied to the first node n1, and the driving pulse VoutK−1 may be supplied to the set node Q through the second switching transistor $T_2$, which may have the gate electrode connected to the first voltage source of the gate low voltage level VGL, and may be turned on. In one example, a voltage corresponding to the gate-on voltage level may even be charged in the first and second capacitors $C_1$ and $C_2$.

The set node Q may be charged to have the gate-on voltage level by the driving pulse supplied thereto. In the output unit outK, the pull-up transistor $T_{pu}$ having the gate electrode connected to the set node Q may be turned on. Thus, the first voltage VDD1 having the gate-on voltage level VGL supplied from the first voltage source may be output as the output pulse VoutK.

At the same time, the driving pulse VoutK−1 having the gate-on voltage level may be also supplied to the seventh switching transistor $T_7$ having the gate electrode connected to the first node n1. Then, the seventh switching transistor $T_7$ may be turned on, and the second voltage VDD2 having the gate-off voltage level, e.g., the gate high voltage level VGH, may be supplied to the reset node QB, thereby discharging the reset node QB. Then, the pull-down transistor $T_{pd}$ of the output unit outK, the gate electrode of the pull-down transistor $T_{pd}$ connected to the reset node QB, and the discharge transistor $T_d$ may be turned off.

In one example, because the inverted clock pulse R_CLK having the gate-off voltage level may be supplied to the gate electrode of the third switching transistor $T_3$, the third switching transistor $T_3$ may be turned off and the fourth switching transistor $T_4$ having the gate electrode, to which the driving pulse VoutK−1 may be supplied, may be turned on. The inverted clock pulse R_CLK having the gate-off voltage level may be supplied to the second node n2, and a voltage corresponding to the voltage level of the inverted clock pulse R_CLK may be stored in the third capacitor $C_3$. For example, the fifth transistor $T_5$ having the gate electrode connected to the second node n2 may be turned off, and the sixth transistor $T_6$, connected, e.g., in a diode form, to the fifth transistor $T_5$ through the third node n3, may also be turned off.

Figure 6B:
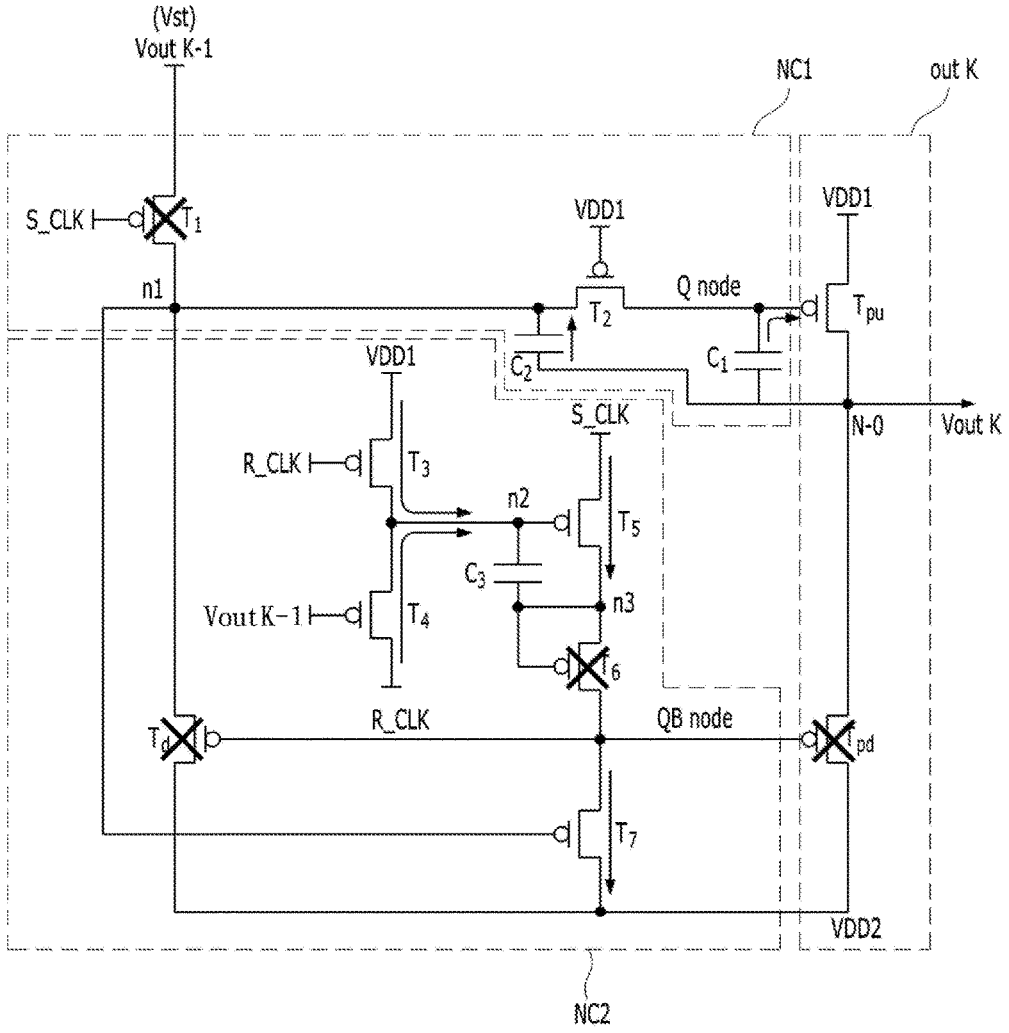
Figure 6C:
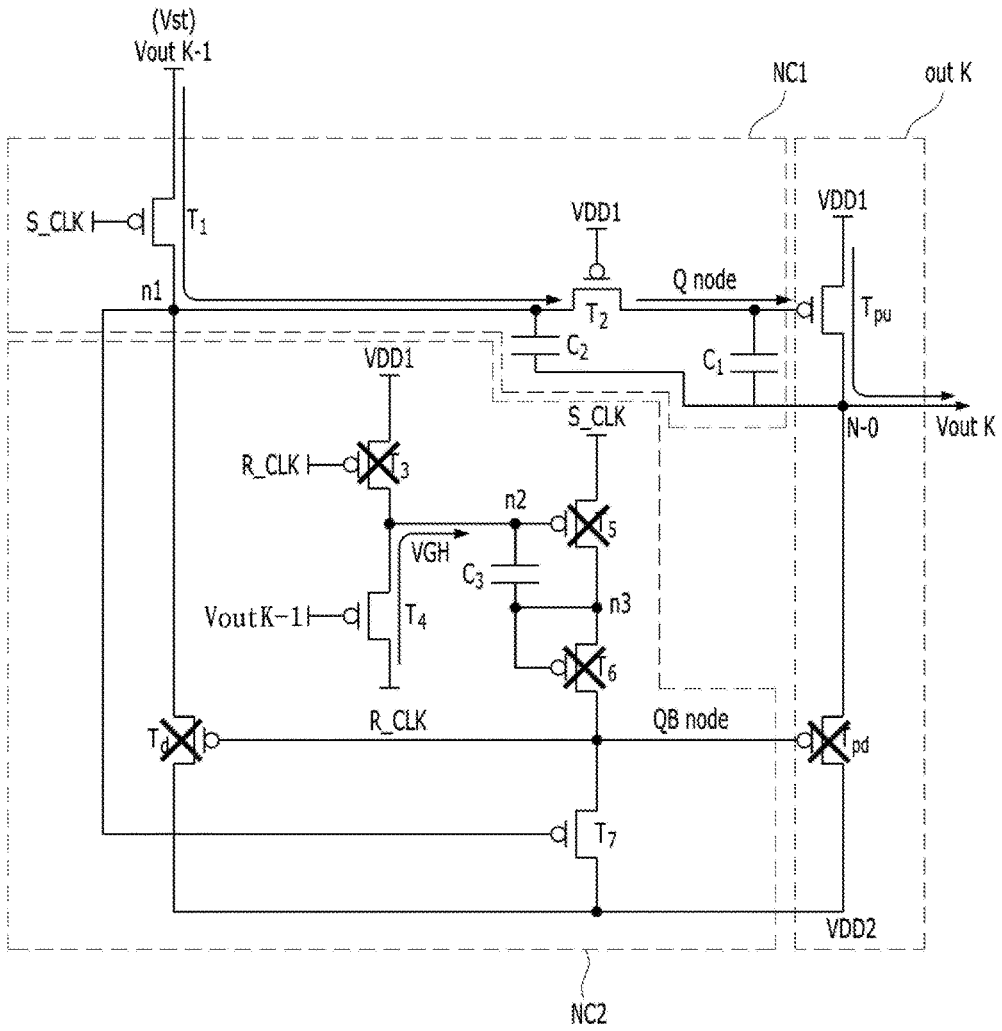

During the maintenance period t2, the reference clock pulse S_CLK may be input to have the gate-off voltage level, the inverted clock pulse R_CLK may be input to have the gate-on voltage level, and the driving pulse may be input to have the gate-on voltage level. In one example, as illustrated in FIG. 6B, the first switching transistor $T_1$ may be turned off by the reference clock pulse S_CLK having the gate-off voltage level. However, as described previously, because a voltage corresponding to the gate-on voltage level may have been charged in the first and second capacitors $C_1$ and $C_2$, the voltage of the set node Q may be maintained at the gate-on voltage level by the first and second capacitors $C_1$ and $C_2$. Then, the pull-up transistor $T_{pu}$ may be also turned on, and the first voltage may be output as the output pulse VoutK through the output terminal N-O.

For example, the voltage stored in the second capacitor $C_2$ may maintain the voltage of the first node n1 at the same gate-on voltage level as the gate electrode level of the second switching transistor $T_2$, and may maintain the gate-source voltage Vgs of the second switching transistor $T_2$ at 0 or more to reduce or prevent leakage of a voltage charged in the set node Q, thereby stabilizing the voltage level of the output pulse VoutK.

The seventh switching transistor $T_7$ connected to the first node n1 may be turned on. Thus, the voltage of the reset node QB may be maintained at the second voltage VDD2, e.g., the gate-off voltage level. Then, the pull-down transistor $T_{pd}$ and the discharge transistor $T_d$ may maintain the turned-off state.

At the same time, the third switching transistor $T_3$ having the gate electrode, to which the inverted clock pulse R_CLK may be input, may be turned on, and the first voltage having the gate-on voltage level supplied from the first voltage source may be supplied to the second node n2. The fourth switching transistor $T_4$ having the gate electrode to which the driving pulse Vout−1 may be input may be turned on, and the inverted clock pulse R_CLK having the gate-on voltage level may be supplied to the second node n2. All of these voltages may have the gate-on voltage level, and may be charged in the third capacitor $C_3$, thereby turning on the fifth switching transistor $T_5$. The fifth switching transistor $T_5$ may supply the reference clock pulse S_CLK having the gate-off voltage level to the third node n3. In one example, the reference clock pulse S_CLK having the gate-off voltage level may be supplied to the sixth switching transistor $T_6$ connected, e.g., in a diode form, to the third node n3, and the sixth switching transistor $T_6$ may maintain the turned-off state. Therefore, the reference clock pulse S_CLK having the gate-off voltage level state supplied from the fifth switching transistor $T_5$ may not affect the reset node QB.

During the charging period t1, a voltage having the gate-off voltage level may be supplied to the third capacitor $C_3$. During the maintenance period t2, a voltage having the gate-on voltage level may be supplied to the third capacitor $C_3$. Therefore, during the active period act in which the charging period t1 and the maintenance period t2 may be repeated, the third capacitor $C_3$ may repeatedly perform charging and discharging. However, because the sixth switching transistor $T_6$ may be turned off during both the charging period t1 and the maintenance period t2, operations of the third to sixth transistors $T_3$ to $T_6$ may not affect the logic state of the reset node QB during the active period act.

Preparation periods t3 and t4 may be provided between the active periods t1 and t2 and inactive periods t5 and t6. During the first preparation period t3, because the same waveform as the charging period t1 of the active period act may be supplied to each stage, the same operation as in the charging period t1 may be performed as illustrated in the FIG. 6C example. Accordingly, the third capacitor $C_3$ may be discharged, as described above. That is, the gate-off voltage level may be stored in the third capacitor $C_3$.

During the second preparation period t4, a voltage having the gate-off voltage level may be supplied to the reference clock pulse S_CLK, a voltage having the gate-on voltage level may be supplied to the inverted clock pulse R_CLK, and a voltage having the gate-off voltage level may be supplied to the driving pulse VoutK−1. That is, during the second preparation period t4, the output pulse Vout−1 of a previous stage or the start pulse Vst may be supplied as an inactive state.

Figure 6D:
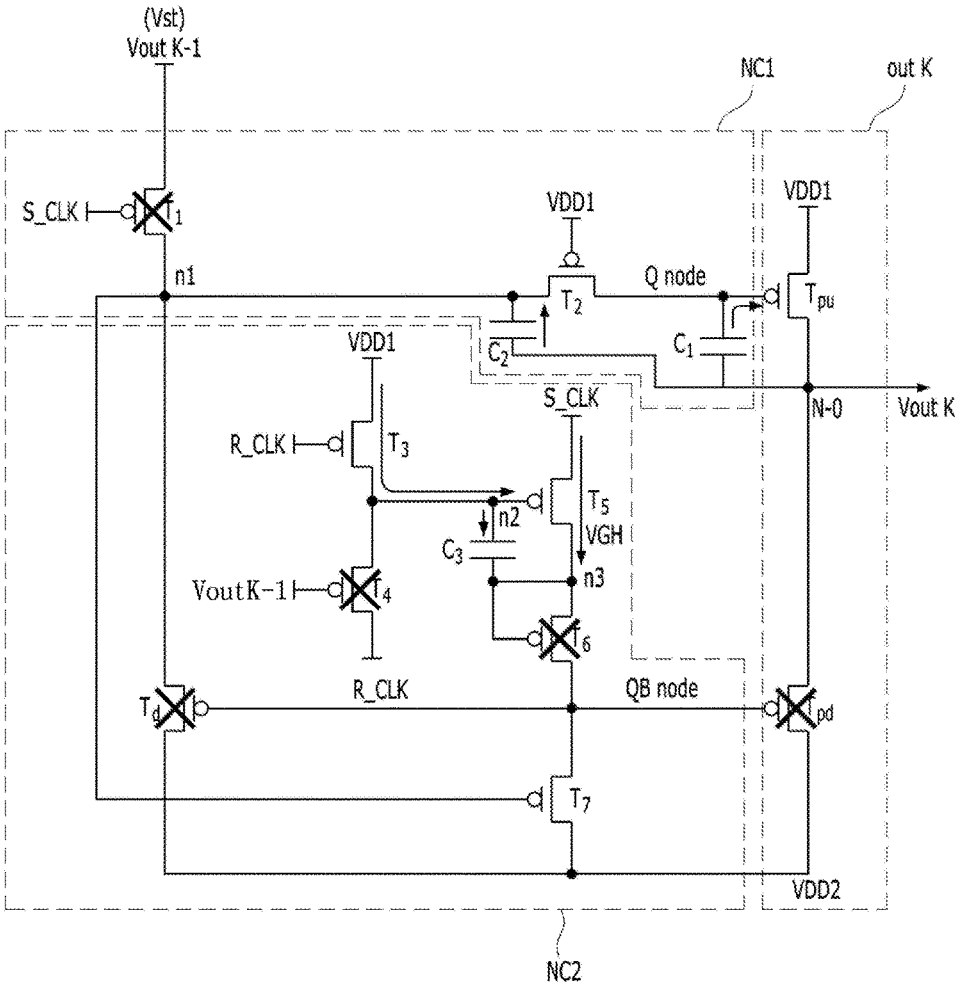

Then, as illustrated in the FIG. 6D example, the first switching transistor $T_1$ may be turned off by the reference clock pulse S_CLK of the gate-off voltage level state, and the set node Q may maintain the gate high voltage level by the first capacitor $C_1$ in a similar manner as in the maintenance period t2. The second capacitor $C_2$ may cause the first node n1 to maintain the gate low voltage level as described above, thereby preventing or reducing the possibility of the second switching transistor $T_2$ from being turned on and reducing or preventing a voltage supplied to the set node Q from leaking. Similarly to the maintenance period t2, the seventh switching transistor $T_7$ connected to the first node n1 may be turned on to supply the second voltage VDD2 to the reset node QB, thereby causing the reset node QB to maintain the gate-off voltage level. Then, the pull-down transistor $T_{pd}$ and the discharge transistor $T_d$ may maintain the turned off state.

At the same time, the third switching transistor $T_3$ may be turned on by the inverted clock pulse R_CLK of the gate-on voltage level state. The fourth switching transistor $T_4$ may be turned off by the driving pulse VoutK−1 of the gate-off voltage level state.

Therefore, the first voltage VDD1 having the gate-on voltage level may be supplied to the second node n2 through the third switching transistor $T_3$, and the first voltage may be charged in the third capacitor $C_3$. Although the fifth switching transistor $T_5$ may be turned on by the second node n2 having the gate-on voltage level, because the reference clock pulse S_CLK of the gate-off voltage level state may be supplied to the sixth transistor $T_6$, the sixth transistor $T_6$ may be turned off, and the reference clock pulse S_CLK may not affect the logic state of the set node QB.

During the first inactive period t5, the reference clock pulse S_CLK may be supplied to have the gate-on voltage level, the inverted clock pulse R_CLK may be supplied to have the gate-off voltage level state, and the driving pulse VoutK−1 may be supplied to have the gate-off voltage level. That is, during the first inactive period t5, the output pulse Vout−1 of a previous stage or the start pulse Vst may be supplied as an inactive state.

Figure 6E:
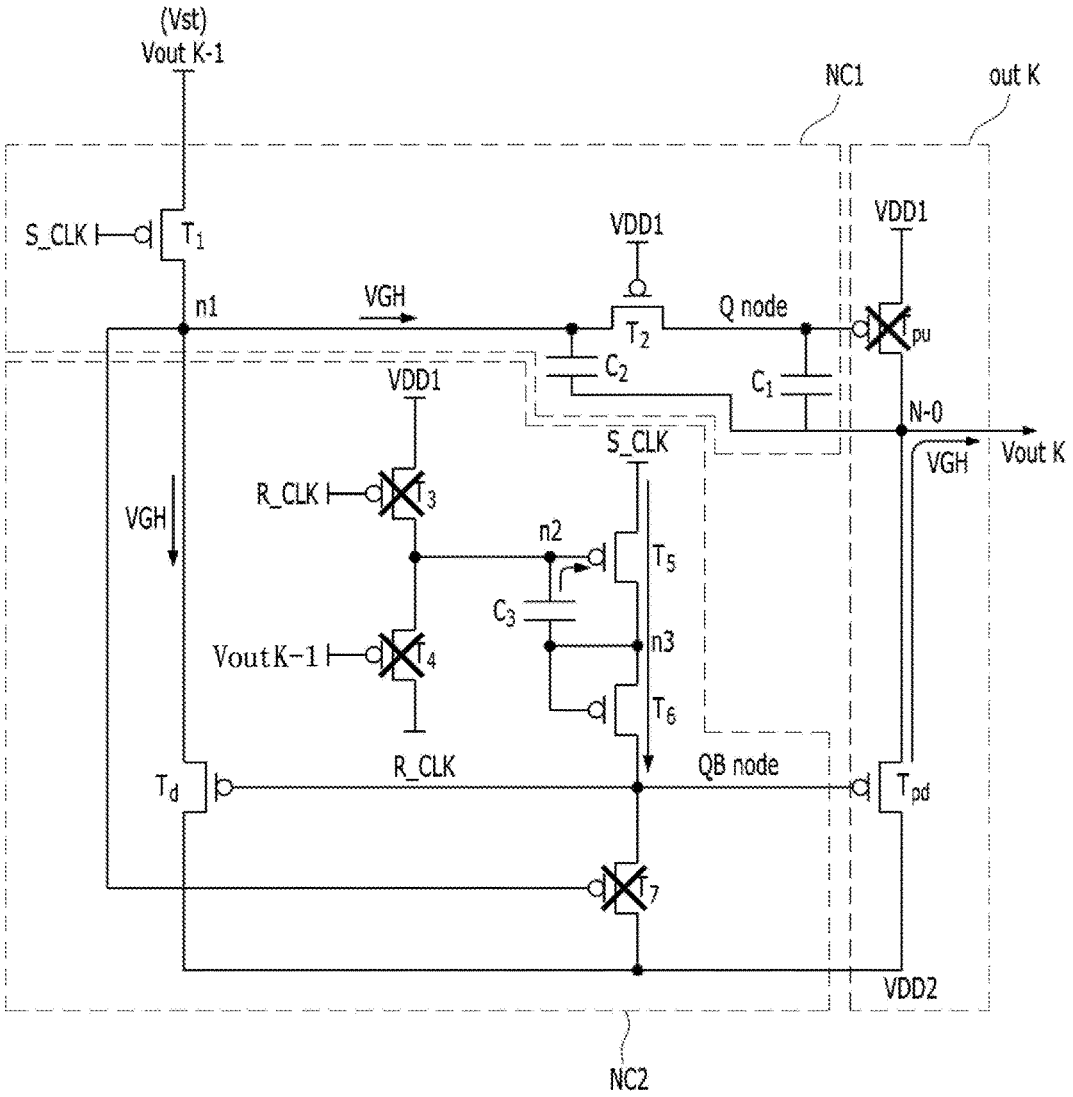

Then, as illustrated in the FIG. 6E example, the first switching transistor $T_1$ may be turned on by the reference clock pulse S_CLK of the gate-on voltage level. In one example, because the driving pulse VoutK−1 may have the gate-off voltage level, the gate-off voltage level may be supplied to the first node n1, and the set node Q and the gate-off voltage may be also charged in the first and second capacitors $C_1$ and $C_2$. The pull-up transistor $T_{pu}$ connected to the set node Q may be turned off. The seventh switching transistor $T_7$ having the gate electrode connected to the first node n1 may also maintain the turned-off state.

Because the inverted clock pulse R_CLK may be in the gate-off voltage level state, the third switching transistor $T_3$ may be turned off. In addition, because the driving pulse Vout−1 may be also in the gate-off voltage level state, the fourth switching transistor $T_4$ may be turned off. However, during the second preparation period t4, because the first voltage having the gate-on voltage level may have been charged in the third capacitor $C_3$, the second node n2 may maintain the gate-on voltage level, and the fifth switching transistor $T_5$ may be turned on. In addition, the reference clock pulse S_CLK of the gate-on voltage level may be supplied to the third node n3 through the fifth switching transistor $T_5$, and the reference clock pulse S_CLK of the gate-on voltage level state may be supplied to the reset node QB through the sixth switching transistor $T_6$ that may be connected, e.g., in a diode form, to the third node n3. Because the reference clock pulse S_CLK of the gate-on voltage level may be charged in the reset node QB, the pull-down transistor $T_{pd}$ and the discharge transistor $T_d$ may be turned on. Then, the second voltage of the gate-off voltage level may be supplied to the output terminal N-O through the pull-down transistor $T_{pd}$ so that the output terminal N-O may output the output pulse VoutK of the gate-off level. In addition, because the discharge transistor $T_d$ may be turned on, the second voltage VDD2 may be supplied to the first node n1, thereby causing the first node n1 and the set node Q to rapidly reach the gate-off voltage level.

During the second inactive period t6, the reference clock pulse S_CLK may be supplied to have the gate-off voltage level state, the inverted clock pulse R_CLK may be supplied to have the gate-on voltage level state, and the driving pulse VoutK−1 may be supplied to have the gate-on voltage level state. That is, during the second inactive period t6, the output pulse Vout−1 of a previous state or the start pulse Vst may be supplied as an active state.

Figure 6F:
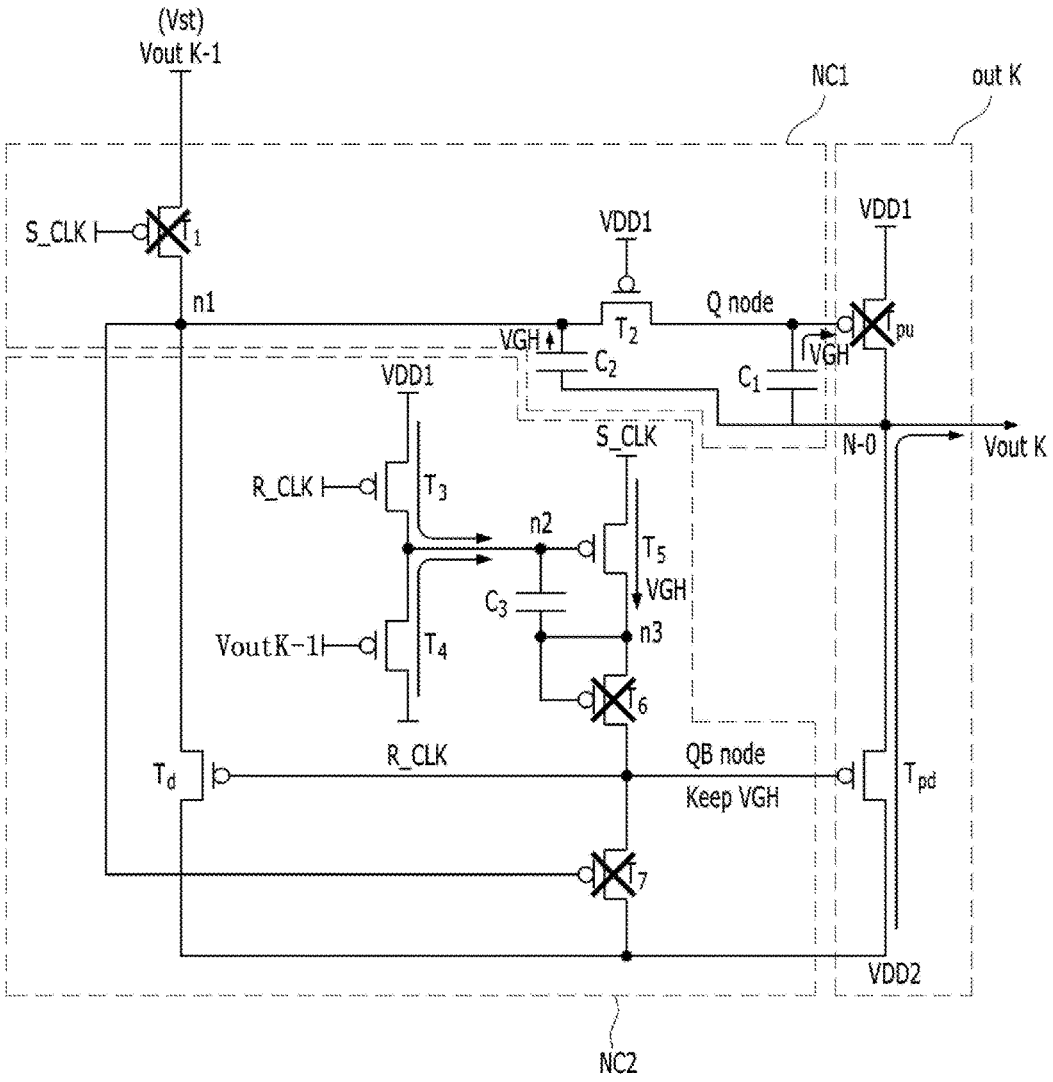

Then, as illustrated in the FIG. 6F example, the first switching transistor $T_1$ may be turned off and the first node n1, and the set node Q may maintain the gate-off voltage level state according to a voltage stored in the first and second capacitors $C_1$ and $C_2$. Thus, the pull-up transistor $T_{pu}$ and the discharge transistor $T_d$ may maintain the turned-off state.

In addition, the third and fourth switching transistors $T_3$ and $T_4$ may be turned on by the inverted clock pulse R_CLK and the driving pulse VoutK−1 of the gate-on voltage level state. The first voltage VDD1 may be supplied to the second node n2 through the source electrode of the third switching transistor $T_3$, and the fifth switching transistor $T_5$ may be turned on to supply the reference clock pulse S_CLK to the third node n3. However, because the reference clock pulse S_CLK may be the gate-off voltage level state, the sixth switching element $T_6$, connected, e.g., in a diode form, to the third node n3, may maintain the turned-off state, and the reference clock pulse S_CLK charged in the third node n3 may not affect the reset node QB.

During the second inactive period t6, the reset node QB may maintain the gate-on voltage level charged during the first inactive period t5. Then, the pull-down transistor $T_{pd}$ and the discharge transistor $T_d$ may be turned on. The pull-down transistor $T_{pd}$ may output the second voltage VDD2 of the gate-off voltage level to the output terminal N-O, and the second voltage VDD2 may be output to the output pulse VoutK through the output terminal N-O as an inactive signal. The discharge transistor $T_d$ may supply the second voltage to the first node n1 and the set node Q, thereby causing the first node n1 and the set node Q to maintain the gate-off voltage state.

Figure 7:
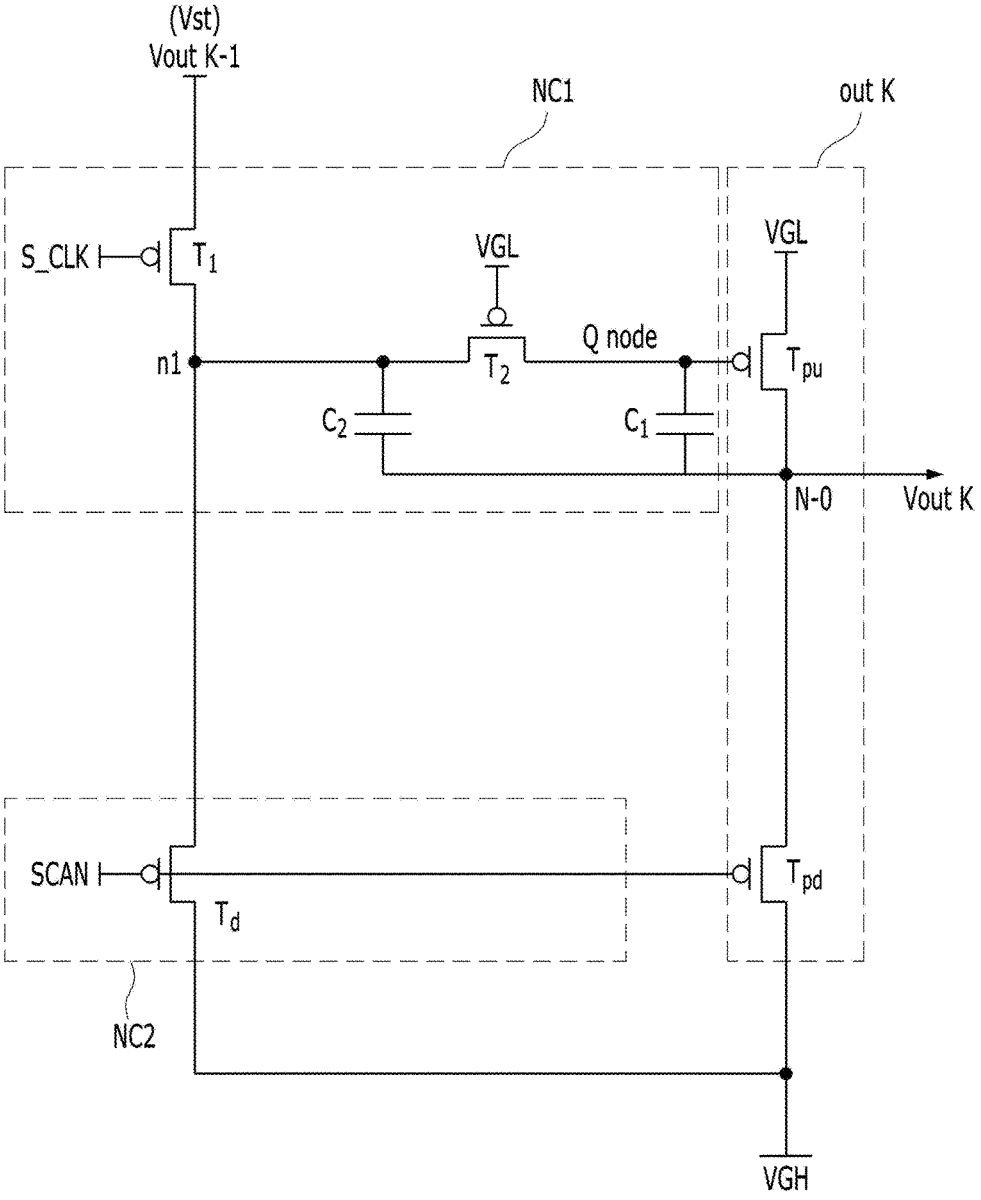
FIG. 7 is a diagram illustrating a light emission controller including a second node controller according to a second embodiment of the present disclosure.

FIG. 7 is a diagram illustrating a light emission controller including a second node controller according to a second embodiment of the present disclosure.

A stage STk may include a first node controller NC1, a second node controller NC2, and an output unit outK. The first node controller NC1 may be similar to that illustrated in the FIG. 2 example. Therefore, a detailed description thereof is omitted.

As illustrated in the FIG. 7 example, the second node controller NC2 may receive a scan pulse SCAN, and may drive gate lines included in an organic light-emitting display device. For example, the scan pulse SCAN may be input to each gate line from a gate driver for driving the gate lines gate and to the second node controller NC2 included in each of the stages ST1 to STn of the light emission controller. In one example, the scan pulse output to each gate line may be input to each stage in one-to-one correspondence.

The second node controller NC2 may include a discharge transistor $T_d$ for connecting a first node n1 to a second voltage source corresponding to a gate-off voltage source in response to the scan pulse SCAN of a gate-on voltage level input to a gate electrode thereof during an inactive period. The second node controller NC2 may include a reset node QB that may receive the scan pulse SCAN during an inactive period, and may be charged with the gate-on voltage level during the inactive period.

A pull-down transistor $T_{pd}$ may have a gate electrode connected to a gate electrode of the discharge transistor $T_d$, a source electrode connected to the second voltage source, and a drain electrode connected to an output terminal N-O of the output unit outK.

The scan pulse SCAN may have an inverted waveform with respect to each output pulse output from each of the stages ST1 to STn of the light emission controller. In other words, the output pulse may be output to have a gate-on voltage level during an active period and a gate-off voltage level during the inactive period, whereas the scan pulse may be output to have one active period per frame. In one example, an active period of the scan pulse may correspond to an inactive period of the output pulse of the light emission controller, and an inactive period of the scan pulse may correspond to an active period of the output pulse.

The pull-down transistor $T_{pd}$ may be turned on in response to the scan pulse during the inactive period, and may output a gate-off voltage level supplied from the second voltage source, e.g., the output pulse VoutK having the gate low voltage level VGL in FIG. 4, through the output terminal N-O. That is, in the node controller NC2 according to the second embodiment, the scan pulse may be supplied to the reset node QB as a pull-down voltage.

As described above, during the active period, the output terminal N-O of each of the stages ST1 to STn may output the output pulse Vout having the gate-on voltage level through a pull-up transistor $T_{pu}$. In one example, the scan pulse SCAN of the gate-off voltage level may be input to the second node controller NC2. Then, during the active period, the reset node QB may have the gate-off voltage level, e.g., the gate high voltage level VGH. Therefore, the pull-down transistor $T_{pd}$ and the discharge transistor $T_d$ may be turned off.

The light emission controller, including second node controller NC2 of FIG. 7 described above, may receive the scan pulse SCAN supplied from the gate driver, and may be driven in the form of an inverter. That is, when the scan pulse SCAN outputs the inactive signal, the light emission controller may output the active signal, and, when the scan pulse SCAN outputs the active signal, the light emission controller may output the inactive signal.

Figure 8:
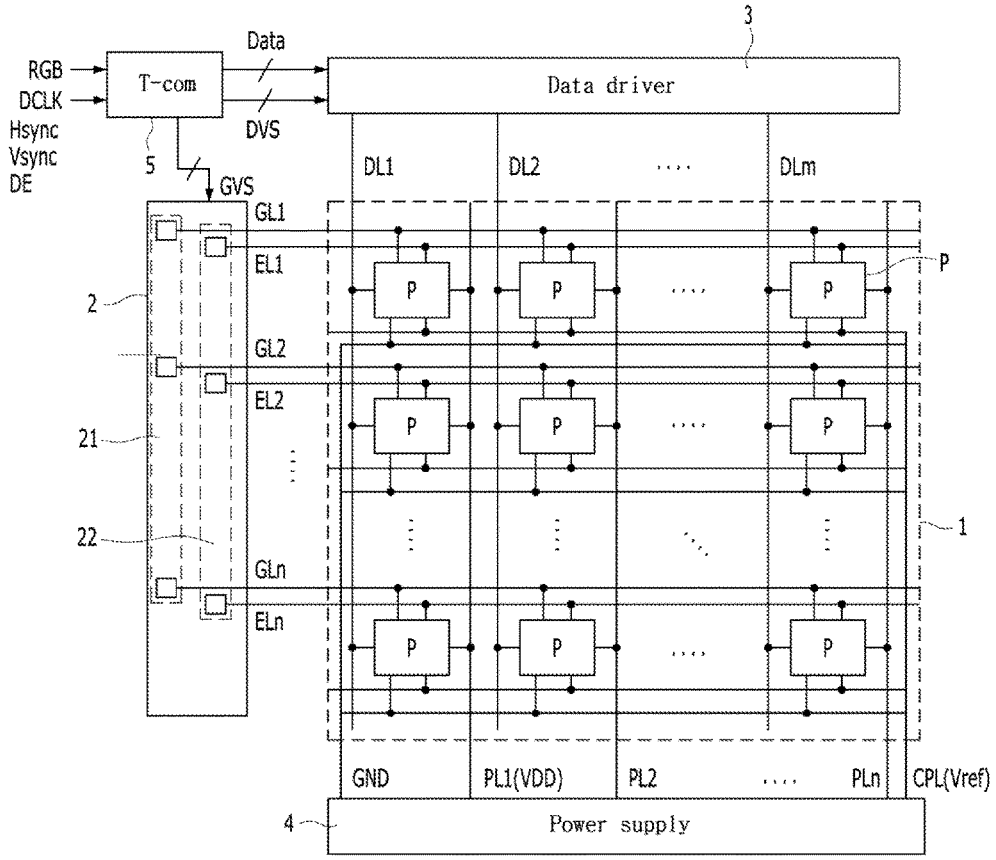
FIG. 8 is a diagram schematically illustrating an organic light-emitting display device including a light emission controller according to an embodiment of the present disclosure.

FIG. 8 is a diagram schematically illustrating an organic light-emitting display device including a light emission controller according to an embodiment of the present disclosure.

The organic light-emitting display device illustrated in the FIG. 8 example may include a display panel 1 formed with a plurality of pixel regions, a scan driver 2 for driving gate lines GL1 to GLn and light emission control lines EL1 to ELn of the display panel 1, a data driver 3 for driving data lines DL1 to DLm of the display panel 1, a power supply 4 for supplying first and second power signals VDD and GND of the display panel 1 to the power lines PL1 to PLn and for supplying a compensation voltage Vref to a compensation power line CPL, and a timing controller 5 for controlling the scan driver 2 and the data driver 3 by a data voltage compensated for by the compensation voltage Vref. The second voltage GND may be a lower voltage, e.g., a ground potential, than the first voltage VDD, although the second voltage GND is not limited to ground potential.

The display panel 1 may display images through a plurality of subpixels P arranged in a matrix form in each pixel region. Each subpixel P may include a light-emitting cell OLD and a cell driver DVD for independently driving the light-emitting cell OLD. (See FIG. 9) For example, each subpixel P illustrated in FIG. 9 may include the cell driver DVD connected to a gate line GL (e.g., GL1 to GLn), a data line DL (e.g., DL1 to DLm), a compensation power line CPL, a light emission control line EL (e.g., EL1 to ELn), and a power line PL (e.g., PL1 to PLn).

The organic light-emitting display device illustrated in the FIG. 8 example may further include a timing controller T-com that may receive signals, e.g., image data RGB, a data clock DCLK, a horizontal synchronization signal Hsync, a vertical synchronization signal Vsync, and a data enable signal DE. The timing controller T-com may provide data Data and a data driver enable signal DVS to the data driver 3, and may provide a gate driver enable signal GVS to the scan driver 2.

The scan driver 2 may include a gate driver 21 and a light emission controller 22. For example, the gate driver 21 and the light emission controller 22 may be configured in the form of a shift register, which may include a plurality of stages as illustrated in the FIG. 1 example. Meanwhile, the light emission controller 22 may serve as an inverter, which may receive a scan signal from the gate driver as illustrated in the example of FIG. 7, and may invert the scan signal to be used as a pull-down voltage.

Figure 9:
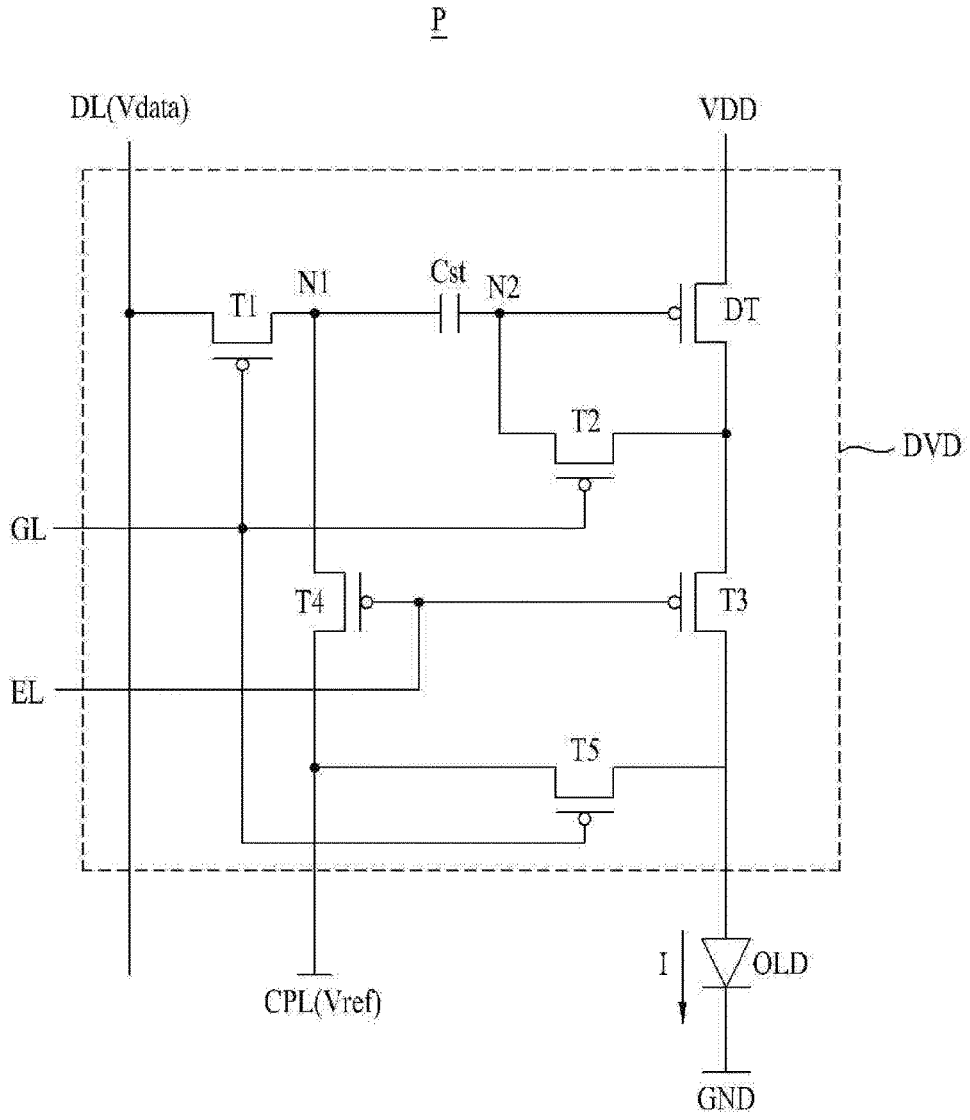
FIG. 9 is a circuit diagram illustrating a cell driver of an organic light-emitting display device according to an embodiment of the present disclosure.

FIG. 9 is a circuit diagram illustrating a cell driver of an organic light-emitting display device according to an embodiment of the present disclosure.

A cell driver DVD may include first to fifth pixel switching elements T1 to T5, a driving switching element DT, and a storage capacitor Cst. The first to fifth pixel switching elements T1 to T5 and the driving switching element DT may include NMOS transistors or PMOS transistors. Hereinafter, an example of configuring the first to fifth pixel switching elements T1 to T5 and the driving switching element DT that have PMOS transistors will be described for convenience.

The first pixel switching element T1 may supply a data signal, supplied from a data line DL, to a first pixel node N1 in response to a gate-on voltage supplied from a gate line GL to a first pixel node N1, thereby charging a voltage corresponding to the data signal Vdata in the storage capacitor Cst. The second pixel switching element $T_2$ may be connected to a gate electrode and a drain electrode of the driving switching element DT in response to the gate-on voltage supplied from the gate line GL to connect the driving switching element DT in a diode form.

The third pixel switching element $T_3$ may connect the drain electrode of the driving switching element DT to an anode of a light-emitting cell OLD in response to a light emission control signal of the gate-on voltage level supplied from a light emission control line EL. That is, the third pixel switching element $T_3$ may supply data current that is output from the driving switching element DT to the light-emitting cell OLD according to the light emission control signal of the gate-on voltage level.

The fourth pixel switching element $T_4$ may supply a compensation voltage Vref, supplied through a compensation power line CPL, to the first pixel node N1, in response to the light emission control signal of the gate-on voltage level supplied from the light emission control line EL. The fifth pixel switching element $T_5$ may supply the compensation voltage Vref, supplied through the compensation power line CPL, to a third pixel node N3 connected to the light-emitting cell OLD in response to the gate voltage of the gate-on voltage level supplied from the gate line GL. In one example, the fifth pixel switching element $T_5$ may not affect a driving process, even though the fifth pixel switching element $T_5$ may be not provided as a stabilization element of the cell driver DVD. The driving switching element DT controls the amount of current flowing into the light-emitting cell OLD in response to a voltage on the second pixel node N2.

The storage capacitor Cst may be provided between the first and second pixel nodes N1 and N2 to store a difference voltage between the first and second pixel nodes N1 and N2. If the first pixel switching element $T_1$ is turned off, the storage capacitor Cst may maintain an on-state of the driving switching element DT using the stored voltage for a predetermined duration, e.g., for one frame duration.

The light-emitting cell OLD may include an anode connected to the cell driver DVD, a cathode connected to a second power signal GND corresponding to a low-potential voltage, and an organic layer formed between the anode and the cathode. The light-emitting cell OLD may emit light based on current from the driving switching element DT through the third pixel switching element $T_3$ of the cell driver DVD.

The organic light-emitting display device according to an embodiment of the present disclosure can output a stable light emission control signal by including the above-described light emission controller. Therefore, the light-emitting element can stably emit light.

The light emission controller, including the first node controller NC1, may further include the second capacitor $C_2$ between the first node n1 and the output terminal N-O. Then, the first node controller NC1 may control the voltage level of the first node n1 using the voltage stored in the second capacitor $C_2$ so that the second switching transistor $T_2$ can be sufficiently turned off.

For example, if the second switching transistor is a p-type transistor, the first node controller NC1 may maintain the gate-to-source voltage Vgs of the second switching transistor $T_2$ at 0 or more by maintaining the voltage level of the first node n1 at a sufficiently low level. Therefore, the second switching transistor $T_2$ can be stably turned off.

In addition, in the light emission controller according to an embodiment of the present disclosure, even if the second switching transistor $T_2$ is floated or is unstably turned on, because the first node n1 may form the same potential as the set node Q, the voltage charged in the set node Q may not leak through the second switching transistor $T_2$.

It will be apparent to those skilled in the art that various modifications and variations may be made in the present disclosure without departing from the technical idea or scope of the disclosure. Thus, it may be intended that embodiments of the present disclosure cover the modifications and variations of the disclosure provided they come within the scope of the appended claims and their equivalents.

What is claimed is:

1. A light emission controller for a display device, comprising:

a plurality of stages cascade-connected to each other, each of the stages comprising:

a first node controller configured to, during an active period, charge a driving pulse of a gate-on voltage level to a set node in response to a reference clock pulse that is any one of a plurality of externally input clock pulses;

a second node controller configured to, during an inactive period, charge a pull-down voltage having the gate-on voltage level to a reset node; and an output unit controlled according to voltage states of the set node and the reset node and configured to output an output pulse of an active state or an inactive state, wherein the first node controller comprises:

a first switching transistor configured to, during the active period, supply the driving pulse of the gate-on voltage level to a first node in response to the reference clock pulse, a second switching transistor configured to supply the driving pulse from the first node to the set node in response to a turn-on voltage, a first capacitor connected between the output unit and the set node, and a second capacitor connected between the output unit and the first node.

2. The light emission controller of claim 1, wherein:

the driving pulse in a first stage, among the plurality of stages, is a start pulse; and the driving pulse in each of the other stages, among the plurality of stages, is an output pulse from a previous stage.

3. The light emission controller of claim 1, wherein the second node controller comprises:

a third switching transistor configured to supply a first voltage having a gate turn-on voltage level to a second node in response to an inverted clock pulse having an inverted phase with respect to the reference clock pulse;

a fifth switching transistor configured to, during the inactive period supply the reference clock pulse to a third node, in response to the first voltage of the second node;

a sixth transistor configured to output the reference clock pulse of the third node to the reset node;

a seventh switching transistor configured to, during the active period, discharge the reset node with a gate-off voltage level in response to the driving pulse of the gate-on voltage level;

a discharge transistor configured to, during the active period, discharge the first node in response to the pull-down voltage;

a third switching capacitor connected between a gate electrode of the fifth switching transistor and a gate electrode of the sixth switching transistor; and a fourth switching transistor configured to:

supply the inverted clock pulse to the second node in response to the driving pulse; and change the second node to the gate-on voltage level or the gate-off voltage level.

4. The light emission controller of claim 1, wherein the output unit comprises:

a pull-up transistor configured to, during the active period, output a light emission control signal of an active state in response to the driving pulse having the gate-on voltage level charged in the set node; and a pull-down transistor configured to, during the inactive period, output a light emission control signal of an inactive state in response to the pull-down voltage charged in the reset node.

5. The light emission controller of claim 4, wherein the pull-down voltage is supplied using the reference clock pulse.

6. The light emission controller of claim 4, wherein:

the active period is divided into a charging period and a maintenance period;

during the charging period, the reference clock pulse is supplied to have the gate-on voltage level and the driving pulse is supplied to have the gate-on voltage level, to charge a driving pulse of the gate-on voltage level in the first and second capacitors; and during the maintenance period, the reference clock pulse is supplied to have a gate-off voltage level to turn off the first switching transistor, and the first and second capacitors maintain a voltage of the set node at the gate-on voltage level.

7. The light emission controller of claim 6, wherein:

first and second preparation periods are between the active period and the inactive period; and the inactive period includes first and second inactive periods.

8. The light emission controller of claim 7, wherein:

the first preparation period is driven identically to the charging period; and during the second preparation period:

the reference clock pulse is supplied to have the gate-off voltage level to turn off the first switching transistor;

the inverted clock pulse is supplied to have the gate-on voltage level to charge the turn-on voltage in a third switching capacitor; and a voltage level of the first voltage is changed to have the gate-off voltage level.

9. The light emission controller of claim 8, wherein, during the first inactive period:

the reference clock pulse is supplied to have the gate-on voltage level, the driving pulse maintains the gate-off voltage level;

the inverted clock pulse is supplied to have the gate-off voltage level to turn off the third switching transistor; and the turn-on voltage charged in the third switching capacitor is supplied to a fifth switching transistor to supply the reference clock pulse to the reset node through the fifth switching transistor and a sixth switching transistor.

10. The light emission controller of claim 9, wherein, during the second inactive period:

the reference clock pulse is supplied to have the gate-off voltage level;

the inverted clock pulse is supplied to have the gate-on voltage level;

the first voltage is supplied to have the gate-on voltage level; and the reset node is maintained at a gate-on voltage level.

11. The light emission controller of claim 1, wherein the pull-down voltage is a scan signal for driving a gate line provided in the display device.

12. The light emission controller of claim 11, wherein:

the second node controller includes a discharge transistor configured to:

receive the gate signal; and change voltages of the first node and the set node to a gate-off voltage level using a gate-off voltage source; and the output unit is configured to output a light emission control signal of the inactive state in response to the pull-down voltage charged in the reset node.

13. An organic light-emitting display device, comprising:

a display panel including:

a light-emitting element;

a pixel driver configured to drive the light-emitting element; and a plurality of pixels in a matrix;

a gate driver configured to supply a scan signal to each of the pixels;

a data driver configured to supply a data signal to each of the pixels;

a light emission controller configured to supply a light emission control signal for controlling light emission of the light-emitting element to each of the pixels; and a timing controller configured to control the gate driver, the data driver, and the light emission controller to control a display timing of each of the pixels.

14. The organic light-emitting display device of claim 13, wherein the light emission controller comprises a plurality of stages cascade-connected to each other, each of the stages comprising:

a first node controller configured to, during an active period, charge a driving pulse of a gate-on voltage level to a set node in response to a reference clock pulse that is any one of a plurality of externally input clock pulses;

a second node controller configured to, during an inactive period, charge a pull-down voltage having the gate-on voltage level to a reset node; and an output unit controlled according to voltage states of the set node and the reset node and configured to output an output pulse of an active state or an inactive state, wherein the first node controller comprises:

a first switching transistor configured to, during the active period, supply the driving pulse of the gate-on voltage level to a first node in response to the reference clock pulse, a second switching transistor configured to supply the driving pulse from the first node to the set node in response to a turn-on voltage, a first capacitor connected between the output unit and the set node, and a second capacitor connected between the output unit and the first node.

15. The organic light-emitting display device of claim 14, wherein the output unit comprises:

a pull-up transistor configured to, during the active period, output a light emission control signal of an active state in response to the driving pulse having the gate-on voltage level charged in the set node; and a pull-down transistor configured to, during the inactive period, output a light emission control signal of an inactive state in response to the pull-down voltage charged in the reset node.

16. The organic light-emitting display device of claim 14, wherein the second node controller comprises:

a third switching transistor configured to supply a first voltage having a gate turn-on voltage level to a second node in response to an inverted clock pulse having an inverted phase with respect to the reference clock pulse;

a fifth switching transistor configured to, during the inactive period, supply the reference clock pulse to a third node in response to the first voltage of the second node;

a sixth switching transistor configured to output the reference clock pulse of the third node to the reset node;

a seventh switching transistor configured to, during the active period, discharge the reset node with a gate-off voltage level in response to the driving pulse of the gate-on voltage level;

a discharge transistor configured to, during the active period, discharge the first node in response to the pull-down voltage;

a third switching capacitor connected between a gate electrode of the fifth switching transistor and a gate electrode of the sixth switching transistor; and a fourth switching transistor configured to:

supply the inverted clock pulse to the second node in response to the driving pulse; and change the second node to the gate-on voltage level or the gate-off voltage level.

17. The organic light-emitting display device of claim 14, wherein the pull-down voltage is a scan signal for driving a gate line provided in the display device.

18. The organic light-emitting display device of claim 17, wherein:

the second node controller includes a discharge transistor configured to:

receive the gate signal; and change voltages of the first node and the set node to a gate-off voltage level using a gate-off voltage source; and the output unit is configured to output a light emission control signal of the inactive state in response to the pull-down voltage charged in the reset node.

19. A method of driving a light emission controller for a display device, the light emission controller including a plurality of stages cascade-connected to each other, each of the stages including a first node controller, a second node controller, and an output unit, the first node controller including a first switching transistor, a second, a first capacitor connected between the output unit and the set node, and a second capacitor connected between the output unit and the first node, the method comprising:

during an active period:

by the first node controller, charging a driving pulse of a gate-on voltage level to a set node in response to a reference clock pulse that is any one of a plurality of externally input clock pulses; and by the first switching transistor, supplying the driving pulse of the gate-on voltage level to a first node in response to the reference clock pulse;

during an inactive period, by the second node controller, charging a pull-down voltage having the gate-on voltage level to a reset node;

controlling the output unit according to voltage states of the set node and the reset node to output an output pulse of an active state or an inactive state; and by the second switching transistor, supplying the driving pulse from the first node to the set node in response to a turn-on voltage.

* * * * *